US010577556B2

(12) United States Patent
Saccomando et al.

(10) Patent No.: US 10,577,556 B2
(45) Date of Patent: Mar. 3, 2020

(54) MICHAEL ADDUCT AMINO ESTERS AS TOTAL BASE NUMBER BOOSTERS FOR MARINE DIESEL ENGINE LUBRICATING COMPOSITIONS

(71) Applicant: The Lubrizol Corporation, Wickliffe, OH (US)

(72) Inventors: Daniel J. Saccomando, Belper (GB); Natasha K. Horn, Oxford (GB); Ewan E. Delbridge, Concord Township, OH (US); Stephen J. Cook, Belper (GB); John K. Pudelski, Cleveland Heights, OH (US); Mark C. Davies, Pudong (CN)

(73) Assignee: The Lubrizol Corporation, Wickliffe, OH (US)

( * ) Notice: Subject to any disclaimer, the term of this patent is extended or adjusted under 35 U.S.C. 154(b) by 82 days.

(21) Appl. No.: 15/580,424

(22) PCT Filed: Jun. 10, 2016

(86) PCT No.: PCT/US2016/036854
§ 371 (c)(1),
(2) Date: Dec. 7, 2017

(87) PCT Pub. No.: WO2016/201201
PCT Pub. Date: Dec. 15, 2016

(65) Prior Publication Data

US 2018/0208868 A1 Jul. 26, 2018

Related U.S. Application Data

(60) Provisional application No. 62/174,746, filed on Jun. 12, 2015.

(51) Int. Cl.
*C10M 133/06* (2006.01)
*C10M 133/50* (2006.01)
*C10M 133/40* (2006.01)

(52) U.S. Cl.
CPC ..... *C10M 133/50* (2013.01); *C10M 133/06* (2013.01); *C10M 133/40* (2013.01); *C10M 2215/26* (2013.01); *C10M 2215/30* (2013.01); *C10N 2230/04* (2013.01); *C10N 2240/103* (2013.01); *C10N 2270/00* (2013.01)

(58) Field of Classification Search
CPC ..... C10M 2215/04
USPC ..... 508/246–250, 476, 259, 260
See application file for complete search history.

(56) References Cited

U.S. PATENT DOCUMENTS

| | | | |
|---|---|---|---|
| 3,172,892 A | 3/1965 | LeSuer et al. | |
| 3,197,405 A | 7/1965 | LeSuer | |
| 3,219,666 A | 11/1965 | Norman et al. | |
| 3,316,177 A | 4/1967 | Dorer, Jr. | |
| 3,340,281 A | 9/1967 | Brannen, Jr. | |
| 3,351,552 A | 11/1967 | LeSuer | |
| 3,381,022 A | 4/1968 | LeSuer | |
| RE26,433 E | 8/1968 | LeSuer et al. | |
| 3,433,744 A | 3/1969 | LeSuer | |
| 3,444,170 A | 5/1969 | Norman et al. | |
| 3,467,668 A | 9/1969 | Gruber et al. | |
| 3,501,405 A | 3/1970 | Willette | |
| 3,542,680 A | 11/1970 | LeSuer | |
| 3,576,743 A | 4/1971 | Widmer et al. | |
| 3,632,511 A | 1/1972 | Liao | |
| 4,234,435 A | 11/1980 | Meinhardt et al. | |
| 4,581,039 A * | 4/1986 | Horodysky | C07C 53/126 44/409 |
| 4,603,161 A * | 7/1986 | Phillips | C08K 5/175 508/476 |
| 5,234,612 A * | 8/1993 | Carlisle | C08G 65/33303 44/391 |
| 6,153,565 A | 11/2000 | Skinner et al. | |
| 6,165,235 A | 12/2000 | Kolp et al. | |
| 6,281,179 B1 | 8/2001 | Skinner et al. | |
| 6,329,327 B1 | 12/2001 | Tanaka et al. | |
| 6,429,178 B1 | 8/2002 | Skinner et al. | |
| 6,429,179 B1 | 8/2002 | Skinner et al. | |
| 6,559,105 B2 | 5/2003 | Abraham et al. | |
| 6,914,037 B2 | 7/2005 | Gatto | |
| 7,238,650 B2 | 7/2007 | Calder et al. | |
| 7,285,516 B2 | 10/2007 | Carrick et al. | |
| 7,727,943 B2 | 6/2010 | Brown et al. | |
| 2005/0065045 A1 | 3/2005 | Wilk et al. | |
| 2005/0198894 A1 | 9/2005 | Migdal et al. | |
| 2006/0014651 A1 | 1/2006 | Esche, Jr. et al. | |
| 2006/0079413 A1 | 4/2006 | Kocsis et al. | |
| 2006/0183647 A1 | 8/2006 | Kocsis et al. | |
| 2008/0119378 A1 | 5/2008 | Gandon et al. | |
| 2008/0280795 A1 | 11/2008 | Fujitsu et al. | |
| 2009/0054278 A1 | 2/2009 | Baumanis et al. | |

(Continued)

FOREIGN PATENT DOCUMENTS

| | | |
|---|---|---|
| EP | 0355895 A | 2/1990 |
| WO | 91/15535 A1 | 10/1991 |

(Continued)

*Primary Examiner* — Ellen M McAvoy

(74) *Attorney, Agent, or Firm* — Michael Miller; Teresan Gilbert

(57) ABSTRACT

A lubricating composition suited to use in a marine diesel engine includes an oil of lubricating viscosity and an amino carboxylate compound of formula (I): $NR^1R^2$—$((CHR^3)_x NR^4)_n$—$(CHR^5)_2$—COY, where $R^1$ and $R^2$ are independently selected from —$(CHR^6)_2$—COY', H, and $C_1C_3$ alkyl and wherein at least one of $R^1$ and $R^2$ is —$(CHR^6)_2$—COY'; or wherein $NR^1R^2$ is a cyclic structure; Y and Y' are independently selected from —$OR^7$, $NHR^7$, and —$N(R^7)_2$; each $R^7$ is independently selected from $C_6$-$C_{12}$ alkyl and $C_6$-$C_{12}$ alkenyl; $R^3$, $R^5$ and $R^6$ are independently selected from H and $C_1$-$C_4$ alkyl; $R^4$ is selected from H, $C_1$-$C_4$ alkyl, and $(CHR^3)_xNH_2$; x is from 2 to 4; and n is at least 1, except where $NR^1R^2$ is a cyclic structure, where n is at least 0.

15 Claims, No Drawings

(56) References Cited

U.S. PATENT DOCUMENTS

| | | | | |
|---|---|---|---|---|
| 2010/0081592 | A1 | 4/2010 | Kocsis et al. | |
| 2010/0197536 | A1 | 8/2010 | Mosier et al. | |
| 2011/0030648 | A1* | 2/2011 | Cook | C10M 129/38 123/196 M |
| 2011/0052673 | A1 | 3/2011 | Tzianabos et al. | |
| 2011/0092403 | A1 | 4/2011 | Lancon et al. | |
| 2012/0015855 | A1* | 1/2012 | Saccomando | C07C 211/21 508/476 |
| 2012/0040876 | A1 | 2/2012 | Preston et al. | |
| 2013/0210689 | A1* | 8/2013 | Saccomando | C10M 133/08 508/186 |
| 2014/0041610 | A1 | 2/2014 | Lancon et al. | |
| 2014/0161830 | A1 | 6/2014 | Anderson et al. | |
| 2014/0179579 | A1* | 6/2014 | Styer | C10M 133/16 508/500 |
| 2014/0287969 | A1* | 9/2014 | Jukes | C10M 159/22 508/332 |
| 2015/0197703 | A1* | 7/2015 | Chahine | C10L 1/2222 508/476 |
| 2015/0218479 | A1* | 8/2015 | Chahine | C10L 1/2222 508/476 |
| 2015/0291907 | A1* | 10/2015 | Saccomando | C10M 133/04 508/476 |
| 2016/0130522 | A1* | 5/2016 | Boons | C10M 169/042 508/409 |
| 2016/0237371 | A1* | 8/2016 | Houten | C10M 169/045 |

FOREIGN PATENT DOCUMENTS

| | | | |
|---|---|---|---|
| WO | 2008/147704 | A1 | 12/2008 |
| WO | 2014/074335 | A1 | 5/2014 |
| WO | 2014/190002 | A1 | 11/2014 |

* cited by examiner

MICHAEL ADDUCT AMINO ESTERS AS TOTAL BASE NUMBER BOOSTERS FOR MARINE DIESEL ENGINE LUBRICATING COMPOSITIONS

CROSS REFERENCE TO RELATED APPLICATION

This application claims priority from PCT Application Serial No. PCT/US2016/036854 filed on Jun. 10, 2016, which claims the benefit of U.S. Provisional Application No. 62/174,746 filed on Jun. 12, 2015, both of which are incorporated in their entirety by reference herein.

BACKGROUND

The invention relates generally to lubricating compositions (lubricants) suited to use in marine diesel engines and finds particular application in connection with an additive for boosting the total base number (TBN) of a marine diesel cylinder lubricant and to a lubricating method.

Marine diesel fuels used in low-speed two-stroke engines often contain a large amount of sulfur. The high-sulfur containing diesel fuels produce acidic combustion products, particularly sulfurous and sulfuric acids. These products can be neutralized using marine diesel cylinder lubricants (MDCLs) having a high base content. There are two common measures of basicity that are commonly used in the field of lubricant additives: Total Base Number (TBN), as measured by ASTM D2896, is a titration that measures both strong and weak bases, while ASTM D4739 (BN) is a titration that measures strong bases but does not readily titrate weak bases, such as certain amines. TBN and BN are expressed as an equivalent in milligrams of potash per gram of oil (mg of KOH/g).

Additives that are commonly used to boost the TBN in MDCL engine oils include detergents that are overbased by insoluble metallic salts, such as calcium or magnesium salts. These yield the corresponding metal carbonate as the lubricant is burned in the engine, which is neutralized by the acidic combustion products. However, if a low sulfur fuel is used, some of the metal carbonate is not neutralized and can be deposited on pistons and other engine components, causing wear over time.

One way to address this problem is to use different lubricants depending on the type of fuel being used. The sulfur level allowed in marine fuels in international waters is much higher than that allowed in some coastal areas (referred to as Environmental Control Areas). Therefore, an MDCL with a high TBN level can be used in international waters, while for coastal and inland waters, a low TBN level MDCL is used. However, it can be uneconomic or impractical to carry two MDCLs with different TBN levels.

Another way to address this problem is to use ashless (i.e., low-ash) compounds as TBN-boosting additives. The following relate generally to low-ash additives for lubricants: U.S. Pub. No. 20120040876, published Feb. 16, 2012, entitled ANTHRANILIC ESTERS AS ADDITIVES IN LUBRICANTS, by Preston et al., discloses ester additives. U.S. Pub. No. 20110092403, published Apr. 21, 2011, and U.S. Pub. No. 20140041610, published Feb. 13, 2014, both entitled CYLINDER LUBRICANT FOR A TWO-STROKE MARINE ENGINE, by Lancon et al., disclose oil-soluble fatty amines. WO2014074335, entitled BASIC ASHLESS ADDITIVES, discloses N-hydrocarbyl-substituted γ-aminoesters and aminothioesters.

Since the MDCL is passed through the cylinder only once, it should also have the ability to neutralize the acidic combustion products quickly.

There remains a need for a low-ash additive which boosts TBN of an MDCL while enabling fast neutralization of combustion products.

BRIEF DESCRIPTION

In accordance with one aspect of the exemplary embodiment, a lubricating composition includes an oil of lubricating viscosity and an amino carboxylate compound of formula (I):

$$NR^1R^2—((CHR^3)_xNR^4)_n—(CHR^5)_2—COY \quad (I),$$

where, $R^1$ and $R^2$ are independently selected from $—(CHR^6)_2—COY'$, H, and $C_1$-$C_3$ alkyl and wherein at least one of $R^1$ and $R^2$ is $—(CHR^6)_2—COY'$; or wherein $NR^1R^2$ is a cyclic structure;

Y and Y" are independently selected from $—OR^7$, $—NHR^7$, and $—N(R^7)_2$;

each $R^7$ is independently selected from $C_6$-$C_{12}$ alkyl and $C_6$-$C_{12}$ alkenyl;

$R^3$, $R^5$ and $R^6$ are independently selected from H and $C_1$-$C_4$ alkyl;

$R^4$ is selected from H, $C_1$-$C_4$ alkyl, and $(CHR^3)_xNH_2$ x is from 2 to 4; and n is at least 1, except where $NR^1R^2$ is a cyclic structure, where n is at least 0.

In accordance with another aspect of the exemplary embodiment, a method of increasing the Total Base Number of a lubricating composition including adding an effective amount of an amino carboxylate compound to the lubricating composition, the amino carboxylate compound having the formula (I):

$$NR^1R^2—((CHR^3)_xNR^4)_n—(CHR^5)_2—COY \quad (I)$$

where, $R^1$ and $R^2$ are independently selected from $—(CHR^6)_2—COY'$, H, and $C_1$-$C_3$ alkyl and wherein at least one of $R^1$ and $R^2$ is $—(CHR^6)_2—COY'$; or wherein $NR^1R^2$ is a cyclic structure;

Y and Y' are independently selected from $—OR^7$, $—NHR^7$, and $—N(R^7)_2$;

each $R^7$ is independently selected from $C_6$-$C_{12}$ alkyl and $C_6$-$C_{12}$ alkenyl;

$R^3$, $R^5$ and $R^6$ are independently selected from H and $C_1$-$C_4$ alkyl;

$R^4$ is selected from H, $C_1$-$C_4$ alkyl, and $(CHR^3)_xNH_2$ x is from 2 to 4; and n is at least 1, except where $NR^1R^2$ is a cyclic structure, where n is at least 0.

In accordance with another aspect of the exemplary embodiment, a lubricating composition includes an oil of lubricating viscosity and an amino carboxylate compound formed by Michael addition of an acylating agent and a polyamine. The acylating agent is represented by the general formula:

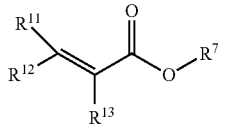

where $R^{13}$ is hydrogen or methyl, $R^{11}$ and $R^{12}$ are each independently selected from the group consisting of hydrogen, an alkyl group having from 1 to 12 carbon atoms, and a group having the formula —$COOR^{14}$ in which $R^{14}$ is hydrogen or an alkyl group having from 1 to 12 or 1-6 carbon atoms. The polyamine is represented by the general formula:

$$NHR^4—((CHR^3)_xNR^4)_n—R^4,$$

where x is from 2 to 4, $R^3$ is selected from H and $C_1$-$C_4$ alkyl, $R^4$ is selected from H, $C_1$-$C_4$ alkyl, and $(CHR^3)_xNH_2$, and n is at least 1.

DETAILED DESCRIPTION

Aspects of the exemplary embodiment relate to an amino-carboxylate compound suited to use as a TBN-booster in a lubricating composition and to a method and use of the lubricating composition.

The exemplary lubricating composition is able to cope with varying fuel sulfur levels. In particular, the exemplary amino-carboxylate compound serves as an ashless TBN booster.

The exemplary amino-carboxylate compound can also have a high acid neutralization rate, making it particularly suited to marine diesel applications. The compound can also be used in the lubricating composition at a high treat rate as it can have a high compatibility with marine engine oils and other components of the lubricating composition.

As used herein, TBN is measured according to ASTM D2896-11, Standard Test Method for Base Number of Petroleum Products by Potentiometric Perchloric Acid Titration, ASTM International, West Conshohocken, Pa. 2011, DOI: 10.1520/D2896-11. BN is measured according to ASTM D4739-11, Standard Test Method for Base Number Determination by Potentiometric Hydrochloric Acid Titration, ASTM International, West Conshohocken, Pa., 2011, DOI: 10.1520/D4739-11. In various aspects, the amino-carboxylate compound has a BN of at least 180 mg of KOH/g, or at least 200, or at least 240 mg of KOH/g, or up to 400 mg of KOH/g.

In various aspects, the amino-carboxylate compound has a TBN of at least 200 mg of KOH/g, or at least 250, or at least 300, or at least 350 or at least 400 mg of KOH/g. The amino-carboxylate compound may have a TBN of up to 600 mg of KOH/g, such as up to 500 mg of KOH/g.

The amino-carboxylate compound is able to increase TBN of the lubricating composition while also providing a good BN. In various aspects, the amino-carboxylate compound can boost the TBN of an engine oil (or a lubricating composition without the amino-carboxylate compound) by at least 20, or at least 30, or at least 40, or at least 50 mg of KOH/g, and in some embodiments, by up to 60 or up to 55 mg of KOH/g. As an example, for a lubricating composition having a TBN of 15 mg of KOH/g, the TBN for a TBN-boosted lubricating composition, which is the same except for the amino-carboxylate compound being present, may be about 70 mg of KOH/g. This can be achieved using the exemplary amino-carboxylate compound at a treat of approximately 15%, based on the weight of the MDCL oil, when the amino-carboxylate compound delivers a TBN of about 400 mg of KOH/g. Even at such a treat rate, the exemplary amino-carboxylate compound can be very compatible with the rest of the components of the lubricating composition and can be a significant amount of the lubricating composition in total. This is achieved, in part, by controlling the polarity of the amino-carboxylate compound. The carboxylate group of the compound promotes solubility in the oil without adversely impacting the TBN of the compound.

The Amino-Carboxylate Compound

Amino-carboxylate compounds useful herein are alkoxylated polyamines terminating in one or more terminating aliphatic chains. Exemplary amino-carboxylate compounds useful in the lubricating composition may have the general formula (I):

$$NR^1R^2—((CHR^3)_xNR^4)_n—(CHR^5)_2—COY \quad (I)$$

where, $R^1$ and $R^2$ are independently selected from —$(CHR^6)_2$—COY', H, and $C_1$-$C_3$ alkyl and wherein at least one of $R^1$ and $R^2$ is —$(CHR^6)_2$—COY'; or wherein $NR^1R^2$ is a cyclic structure, Y and Y' are independently selected from —$OR^7$, —$NHR^7$, and —$N(R^7)_2$;

each $R^7$ is independently selected from $C_6$-$C_{12}$ alkyl and $C_6$-$C_{12}$ alkenyl;

$R^3$, $R^5$ and $R^6$ are independently selected from H and $C_1$-$C_4$ alkyl;

$R^4$ is selected from H, $C_1$-$C_4$ alkyl, and $(CHR^3)_xNH_2$ x is from 2 to 4; and n is at least 1, except where $NR^1R^2$ is a cyclic structure, where n is at least 0.

In various aspects:

a. x is 2.

b. n is up to 7, or up to 6, or up to 5, or up to 4.

c. At least one of Y and Y' is —$OR^7$.

d. Each $R^7$ is selected from $C_6$-$C_{10}$ alkyl and $C_6$-$C_{10}$ alkenyl.

e. Each $R^7$ is selected from $C_6$-$C_8$ alkyl and $C_6$-$C_8$ alkenyl, such as a $C_8$ alkyl, e.g., a branched $C_8$ alkyl.

f. At least one of $R^3$, $R^4$, $R^5$ and $R^6$ is H.

g. $R^3$, $R^4$, $R^5$ and $R^6$ are all H.

h. $NR^1R^2$ is a cyclic structure, and where:

$R^1$ is a $C_1$-$C_3$ alkyl;

m is at least 2;

X is selected from H and —$(CH_2)_p$—W;

W is selected from $COOR^8$, $NHR^8$, and a cyclic structure as described for $NR^1R^2$ except that a terminal X is H or $C_1$-$C_4$ alkyl;

$R^8$ is selected from H, $C_6$-$C_{30}$ alkyl, and $C_6$-$C_{30}$ alkenyl, and —$(CH_2)_p$—W', where W' is as for W, except that a terminal X is H or $C_1$-$C_4$ alkyl;

each p is from 2 to 4.

As will be appreciated, these aspects can also be used in combinations thereof.

$C_1$-$C_3$ alkyl groups useful as $R^1$ include methyl, ethyl, and n-propyl groups.

$C_1$-$C_4$ alkyl groups useful as $R^3$, $R^4$, $R^5$ and $R^6$ include methyl, ethyl, n-propyl and n-butyl groups.

$C_6$-$C_{12}$ alkyl and $C_6$-$C_{12}$ alkenyl groups useful as $R^7$ include straight chain and branched alkyl and alkenyl groups. Specific examples of branched alkyl groups include isooctyl and 2-ethylhexyl groups. Cyclic structures useful as $NR^1R^2$ include optionally substituted heterocycles containing an additional hetero atom such as oxygen or nitrogen. Examples include 6-membered heterocycles where the additional heteroatom in the ring may be nitrogen. In this case, the additional nitrogen may be linked to one or more equivalent cyclic structures, such as a chain of up to 10, or up to 3 equivalent cyclic structures, on average.

Illustrative examples of the amino-carboxylate compound include those in which wherein at least one of $R^1$ and $R^2$ is —$(CHR^6)_2$—COY', e.g., according to Structure (II), and those in which $NR^1R^2$ is a cyclic structure, e.g., according to Structure (III):

(II)

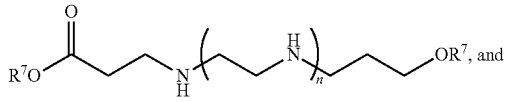

(III)

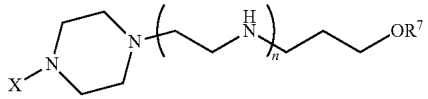

where $R^7$, n, and X may be as described above.

Specific examples of Structure (II) are those where n is at least 3, such as 3 or 4, or up to 6, and/or where each $R^7$ is selected from linear and branched $C_6$-$C_8$ alkyl and alkenyl groups. In one embodiment, the amino-carboxylate compound is an aminoester in which n is from 3-6, or 3-4, and $R^7$ is selected from linear and branched $C_6$-$C_{12}$ or $C_6$-$C_8$ alkyl and alkenyl groups.

Examples of Structure (II) include those of Structures (IV)-(VIII):

(IV)

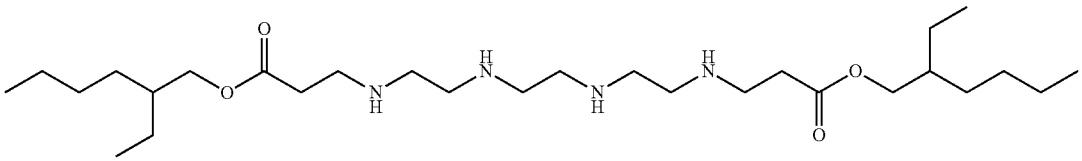

(V)

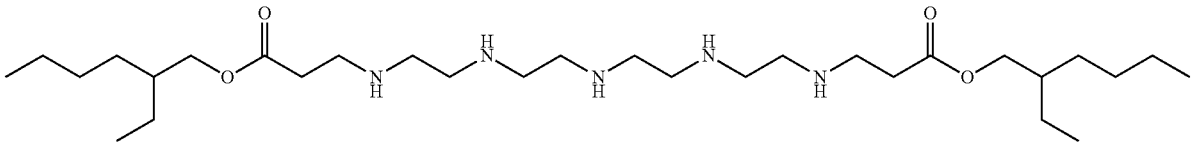

(VI)

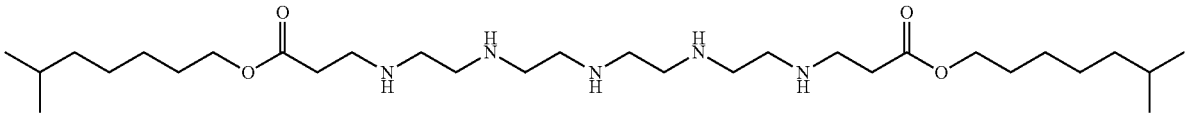

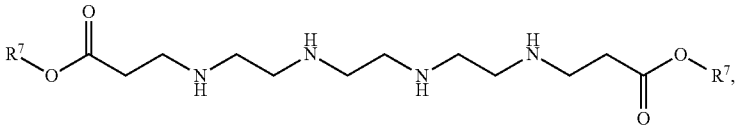

where each $R^7$ is a $C_{10}$-$C_{12}$ alkyl

VII and

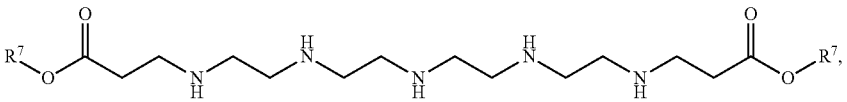

where each $R^7$ is a $C_{10}$-$C_{12}$ alkyl.

VIII

Examples of Structure (VII) include branched alkyl groups such as:

(IX)

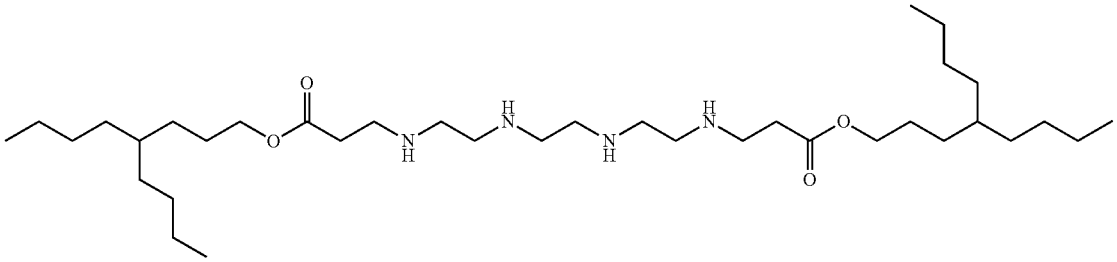

and (X)

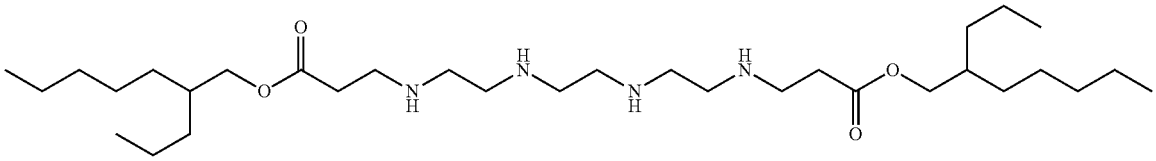

In one embodiment, amino-esters of Structures (II) and (VIII) may be esters of branched aliphatic groups containing 4 to 14 carbon atoms, 6 to 12 carbon atoms, or 8 to 10 carbon atoms. Examples of suitable alkyl groups include butyl, isobutyl, pentyl, isopentyl, neopentyl, hexyl, amyl, heptyl, octyl, iso-octyl, 2-ethylhexyl, nonyl, decyl, iso-decyl, undecyl, dodecyl, 2-propylheptyl, tridecyl, isotridecyl, tetradecyl, 4-methyl-2-pentyl, propyl heptyl, and combinations thereof.

Specific examples of Structure (III) are those where n is from 1 to 4, such as 1 or 2, and/or where each $R^7$ is selected from $C_6$-$C_8$ alkyl and alkenyl groups, and/or when X is selected from H, $C_1$-$C_4$ alkyl, —$(CH_2)_p$—$COOR^8$, and —$(CH_2)_p$—$NHR^8$, and/or where p is 2, and/or where $R^8$ is selected from H, and —$(CH_2)_p$—$COOR^9$, where $R^9$ may be selected from H and $C_1$-$C_4$ alkyl.

Examples of Structure (III) include those of Structures (XI)-(XIII):

Other examples of cyclic structures include those where the N at position 4 is replaced with O, such as:

(XIV)

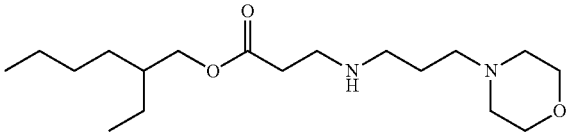

In one embodiment, the amino-carboxylate compound has a weight average molecular weight of up to 750, such as up to 700, or up to 650, or up to 600. In some embodiments, the weight average molecular weight is at least 250 or at least 275, or at least 300, or at least 400.

In some embodiments, the amino-carboxylate compound is free of heterocyclic nitrogen groups that are hydrogenated.

(XI)

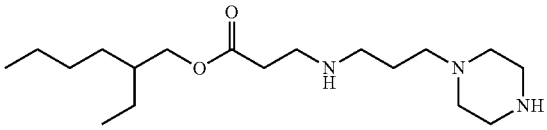

(XII)

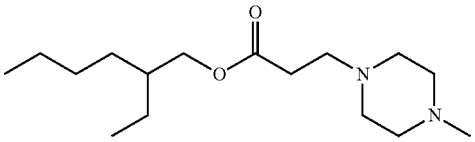

(XIII)

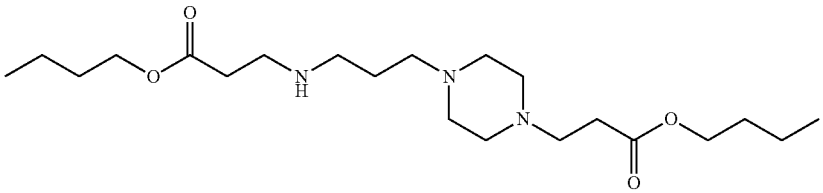

In some embodiments, the amino-carboxylate compound is fully saturated and is free of alkenyl groups.

Method of Forming the Amino-Carboxylate Compound

In an exemplary embodiment, the amino-carboxylate compound is prepared by a Michael addition of a polyamine, such as a poly(alkylamine), with an acylating agent, such as an ethylenically unsaturated ester or carboxylic acid amide. An example of the reaction using an acrylate ester is shown in Scheme 1 below.

Scheme 1

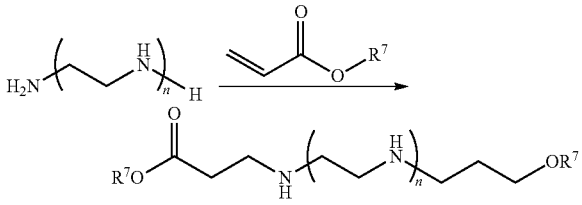

A specific example is shown in Scheme 2.

Scheme 2

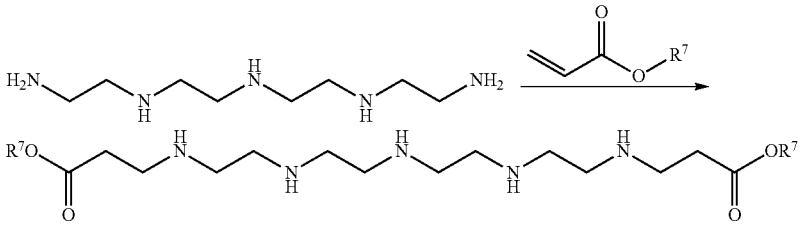

In the above, n and $R^7$ are as described above. In specific examples, $R^7$ is iso-octyl or 2-ethylhexyl.

The reaction may be conducted in a solvent and may employ a catalyst such as a zirconium (Zr)-based catalyst or may be conducted in the absence of catalyst. A suitable Zr-based catalyst may be prepared by combining an aqueous solution of $ZrOCl_2$ with a substrate such as montmorillonite clay, with heating followed by drying. Relative amounts of the reactants and the catalyst may be varied within bounds that will be apparent to the person skilled in the art. The ester and the amine may be used in approximately a 1:1 molar ratio, or alternatively with a slight molar excess of one reactant or the other, e.g., a ratio of ester:amine of 0.9:1 to 1.2:1, or 1:1 to 1.1:1, or 1.02:1 to 1.08:1. The amount of Zr catalyst, if used (excluding support material), may be, for example, 0.5 to 5 g per 100 g of reactants (amine+ester), or 1 to 4 g, or 2 to 3 g, per 100 g of reactants.

The Michael addition reaction may be conducted at a temperature of 10 to 33° C., or alternatively 15 to 30° C. or 18 to 27° C. or 20 to 25° C. or yet in other embodiments 10 to 80° C. or 15 to 70° C. or 18 to 60° C. or 20 to 55° C. or 25 to 50° C. or 30 to 50° C. or 45 to 55° C. Solvent may be used during the reaction if desired, and a suitable solvent may be an alcohol, such as methanol or other protic solvent. If such a solvent is present, it may be present in an amount of 5 to 80 wt. % of the total reaction mixture (including the solvent), for instance, 10 to 70 wt. % or 12 to 60 wt. % or 15 to 50 wt. % or 18 to 40 wt. % or 20 to 30 wt. %, or 18 to 25 wt. %, or about 20 wt. %. The presence of such a solvent may lead to an increased rate of reaction and may facilitate reaction at lower temperatures. Specific optimum conditions may vary depending on the materials employed and can be determined by the person of ordinary skill. At the end of the reaction, the catalyst may be removed by filtration and the solvent, if any, may be removed by evaporation under vacuum. The solvent may be removed under vacuum at a temperature of up to 40° C. or up to 35° C. or up to 30° C. or up to 27° C. or up to 25° C.

Suitable ethylenically unsaturated esters and carboxylic acid amides useful herein include those represented by the general formula:

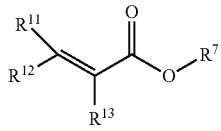

in which $R^{13}$ is hydrogen or methyl, $R^{11}$ and $R^{12}$ are each independently hydrogen, an alkyl group having from 1 to 12 carbon atoms, or a group of the formula —$COOR^{14}$ in which $R^{14}$ is hydrogen or an alkyl group having from 1 to 12 or 1-6 carbon atoms, or a higher homolog thereof.

Examples of suitable ethylenically unsaturated esters include (meth)acrylates, fumarates and maleates which derive from saturated alcohols, such as 2-ethylhexyl (meth) acrylate, heptyl (meth)acrylate, 2-tert-butylheptyl (meth) acrylate, octyl (meth)acrylate, 3-isopropylheptyl (meth) acrylate, nonyl (meth)acrylate, decyl (meth)acrylate, undecyl (meth)acrylate; and the corresponding fumarates and maleates. The expression "(meth)acrylates" encompasses methacrylates and acrylates and also mixtures of the two.

The TBN of the resulting compound can be adjusted through the selection of the acrylate ester.

The polyamine which reacts with the ester and/or or amino ester may be represented by the general formula:

$$NHR^4—((CHR^3)_xNR^4)_n—R^4,$$

where x, n, $R^3$, and $R^4$ are as described above, or when the terminal groups are bonded to each other to form a ring.

Suitable polyamines of this type include aliphatic polyamines, such as polyethyleneimines, polypropyleneimines, polybutyleneimines, and polypentyleneimines, and heterocyclic polyalkylamines, such as piperazines and N-aminoalkyl-substituted piperazines.

Specific examples of poly(alkylamines) include ethylenediamine, diethylenetriamine (DETA), triethylenetetramine (TETA), tris-(2-aminoethyl)amine, propylenediamine, trimethylenediamine, tripropylenetetramine, tetraethylenepentamine, hexaethyleneheptamine, pentaethylenehexamine, and mixtures thereof. Particularly useful polyamines are linear ethylene polyamines with from 4-8 nitrogen groups, such as 4-5, in the case of compounds of Structure(II).

Higher homologs obtained by condensing two or more of the above-noted polyakylamines are similarly useful.

Polyethylenemines can be prepared by the reaction of ethylene dichloride with ammonia or by reaction of an ethylene imine with a ring opening reagent such as water, ammonia, or the like. These reactions result in the production of a complex mixture of polyakylamines including cyclic condensation products such as piperazines.

Other useful types of polyamine mixtures are those resulting from stripping of the above-described polyamine mixtures to leave as residue what is often termed "polyamine bottoms." In general, alkylenepolyamine bottoms can be characterized as having less than two, usually less than 1% (by weight) material boiling below 200° C. A typical product may thus contain small amounts of the lighter amines such as DETA and TETA, with the majority of the mixture being tetraethylene pentamine and pentaethylenehexamine and higher (by weight). These alkylenepolyamine bottoms may include cyclic condensation products such as piperazine and higher analogs of diethylenetriamine, triethylenetetramine and the like.

These alkylenepolyamine bottoms can be reacted solely with the acylating agent or they can be used with other amines, polyamines, or mixtures thereof.

Another useful polyamine is the product of a condensation reaction between at least one hydroxy compound with at least one polyamine reactant containing at least one primary or secondary amino group. The hydroxy compound may be a polyhydric alcohol or polyhydric amine. Examples of alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol is diethylene glycol, triethylene glycol, glycerol, sorbitol, pentaerythritol or dipentaerythritol. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N, N,N',N'-tetrakis(2-hydroxyethyl)ethylenediamine.

Polyamines, which react with the polyhydric alcohol or amine to form the condensation products, include triethylenetetramine (TETA), tetraethylenepentamine (TEPA), pentaethylenehexamine (PEHA), and mixtures of polyamines such as the above-described "amine bottoms."

The condensation reaction of the polyamine reactant with the hydroxy compound is conducted at an elevated temperature, usually 60° C. to 265° C., (e.g., 220° C. to 250° C.) in the presence of an acid catalyst.

Lubricating Composition

The amino-carboxylate compound may be present in the lubricating composition at a concentration of at least 0.5 wt. % and may be up to 20 wt. %. For example, the concentration of the amino-carboxylate compound may be at least 1 wt. %, or at least 5 wt. %, or at least 10 wt. %, or at least 15 wt. %. The compound may also be present in a concentrate, alone or with other additives and with a lesser amount of oil. In a concentrate, the amount of the compound may be at least 2, or at least 3 times the concentration in the lubricating composition. In the lubricating composition, the amount may be suitable to provide at least 1.0, or at least 5, or at least 10 TBN to the lubricating composition, and in some embodiments up to 60 TBN.

In addition to the amino-carboxylate compound, the exemplary lubricating composition includes an oil of lubricating viscosity and optionally one or more additional performance additives suited to providing the performance properties of a fully formulated lubricating composition, e.g., a marine diesel cylinder lubricant. Examples of these additional performance additives include (overbased) detergents, viscosity modifiers, friction modifiers, antioxidants, dispersants, antiwear/antiscuffing agents, metal deactivators, extreme pressure agents, foam inhibitors, demulsifiers, pour point depressants, corrosion inhibitors, seal swelling agents, and the like, which may be used singly or in combination.

Oil of Lubricating Viscosity

The lubricating composition may include the oil of lubricating viscosity as a minor or major component thereof, such as at least 5 wt. %, or at least 10 wt. %, or at least 20 wt. %, or at least 30 wt. %, or at least 40 wt. %, or at least 60 wt. %, or at least 80 wt. % of the lubricating composition.

Suitable oils include natural and synthetic oils, oil derived from hydrocracking, hydrogenation, and hydrofinishing, unrefined, refined, re-refined oils or mixtures thereof. Unrefined, refined and re-refined oils, and natural and synthetic oils are described, for example, in WO2008/47704 and US Pub. No. 2010/197536. Synthetic oils may also be produced by Fischer-Tropsch reactions and typically may be hydroisomerized Fischer-Tropsch hydrocarbons or waxes. Oils may be prepared by a Fischer-Tropsch gas-to-liquid synthetic procedure as well as other gas-to-liquid procedures.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarized in U.S. Pat. No. 7,285,516. The five base oil groups are as follows: Group I (sulfur content >0.03 wt. %, and/or <90 wt. saturates, viscosity index 80-120); Group II (sulfur content ≤0.03 wt. %, and ≥90 wt. % saturates, viscosity index 80-120); Group III (sulfur content ≤0.03 wt. and ≥90 wt. % saturates, viscosity index ≥120); Group IV (all polyalphaolefins (PAOs)); and Group V (all others not included in Groups I, II, III, or IV). The exemplary oil of lubricating viscosity includes an API Group I, Group II, Group III, Group IV, Group V oil, or mixtures thereof. In some embodiments, the oil of lubricating viscosity is an API Group I, Group II, Group III, or Group IV oil, or mixtures thereof. In some embodiments, the oil of lubricating viscosity is an API Group I, Group II, or Group III oil, or mixture thereof. In one embodiment the oil of lubricating viscosity may be an API Group II, Group III mineral oil, a Group IV synthetic oil, or mixture thereof. In some embodiments, at least 5 wt. %, or at least 10 wt. %, or at least 20 wt. %, or at least 40 wt. % of the lubricating composition is a polyalphaolefin (Group IV).

The oil of lubricating viscosity may have a kinematic viscosity of up to 30 $mm^2/s$ or up to 25 $mm^2/s$ (cSt) at 100° C. and can be at least 12 $mm^2/s$ at 100° C., and in other embodiments at least 15 $mm^2/s$. As used herein, kinematic viscosity is determined at 100° C. by ASTM D445-14, "Standard Test Method for Kinematic Viscosity of Transparent and Opaque Liquids (and Calculation of Dynamic Viscosity)," ASTM International, West Conshohocken, Pa., 2003, DOI: 10.1520/D0445-14 and may be referred to as KV_100.

The viscosity grade of cylinder oils suited to use in 2-stroke marine diesel engines may be from SAE-40 to SAE-60, which corresponds to a KV_100 of 12.5 to 26 $mm^2/s$. SAE-50 grade oils, for example, have a KV_100 of 16.3-21.9 $mm^2/s$. Cylinder oils for 2-stroke marine diesel engines may be formulated to achieve a KV_100 of 19 to 21.5 $mm^2/s$. This viscosity can be obtained by a mixture of additives and base oils, for example containing mineral bases of Group I such as Neutral Solvent (for example 500 NS or 600 NS) and Bright Stock bases. Any other combination of mineral or synthetic bases or bases of vegetable origin having, in mixture with the additives, a viscosity compatible with the grade SAE 50 can be used.

As an example, an oil formulation suited to use as a cylinder lubricant for low-speed 2-stroke marine diesel engines contains 18 to 25 wt. % of a Group I base oil of a BSS type (distillation residue, with a KV_100 of about 28-32 $mm^2/s$, with a density at 15° C. of 895-915 $kg/m^3$), and 50 to 60 wt. % of a Group I base oil of a SN 600 type (distillate, with a density at 15° C. of 880-900 $kg/m^3$, with a KV_100 of about 12 $mm^2/s$).

In certain embodiments, the lubricating composition may contain synthetic ester base fluids. Synthetic esters may have a kinematic viscosity measured at 100° C. of 2.5 $mm^2/s$ to 30 $mm^2/s$. In one embodiment, the lubricating composition comprises less than 50 wt. % of a synthetic ester base fluid with a KV_100 of at least 5.5 $mm^2/s$, or at least 6 $mm^2/s$, or at least 8 $mm^2/s$.

Exemplary synthetic oils include poly-alpha olefins, polyesters, polyacrylates, and poly-methacrylates, and co-polymers thereof. Example synthetic esters include esters of a dicarboxylic acid (e.g., selected from phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with an alcohol (e.g., selected from butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and from polyol ethers such as neopentyl glycol, trimethylolpropane, pentaerythritol, dipentaerythritol, and tripentaerythritol. Esters can also be monoesters, such as are available under the trade name Priolube 1976™ ($C_{18}$-alkyl-COO—$C_{20}$-alkyl).

Synthetic ester base oils may be present in the lubricating composition of the invention in an amount less than 50 wt. % of the composition, or less than 40 weight %, or less than 35 weight %, or less than 28 weight %, or less than 21 weight %, or less than 17 weight %, or less than 10 weight %, or less than 5 weight % of the composition. In one embodiment, the lubricating composition of the invention is free of, or substantially free of, a synthetic ester base fluid having a KV_100 of at least 5.5 $mm^2/s$.

Example natural oils include animal and vegetable oils, such as long chain fatty acid esters. Examples include linseed oil, sunflower oil, sesame seed oil, beef tallow oil, lard oil, palm oil, castor oil, cottonseed oil, corn oil, peanut oil, soybean oil, olive oil, whale oil, menhaden oil, sardine oil, coconut oil, palm kernel oil, babassu oil, rape oil, and soya oil.

The amount of the oil of lubricating viscosity present is typically the balance remaining after subtracting from 100 weight % the sum of the amount of the exemplary aminocarboxylate compound and the other performance additives.

Detergents

The lubricating composition optionally further includes at least one detergent. Exemplary detergents useful herein include overbased metal-containing detergents. The metal of the metal-containing detergent may be zinc, sodium, calcium, barium, or magnesium. The overbased metal-containing detergent may be chosen from sulfonates, non-sulfur containing phenates, sulfur containing phenates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where a hybrid sulfonate/phenate detergent is employed, the hybrid detergent can be considered equivalent to amounts of distinct phenate and sulfonate detergents introducing like amounts of phenate and sulfonate soaps, respectively.

Example overbased metal-containing detergents include zinc, sodium, calcium and magnesium salts of sulfonates, phenates (including sulfur-containing and non-sulfur containing phenates), salixarates and salicylates. Such overbased sulfonates, salixarates, phenates and salicylates may have a total base number of 120 to 700, or 250 to 600, or 300 to 500 (on an oil free basis).

The overbased sulfonate detergent may have a metal ratio of 12 to less than 20, or 12 to 18, or 20 to 30, or 22 to 25.

Typically, an overbased metal-containing detergent may be a zinc, sodium, calcium or magnesium salt of a sulfonate, a phenate, sulfur containing phenate, salixarate or salicylate. Overbased sulfonates, salixarates, phenates and salicylates typically have a total base number of 120 to 700 TBN. Overbased sulfonates typically have a total base number of 120 to 700, or 250 to 600, or 300 to 500 (on an oil free basis).

The overbased sulfonate detergent may have a metal ratio of 12 to less than 20, or 12 to 18, or 20 to 30, or 22 to 25.

Example sulfonate detergents include linear and branched alkylbenzene sulfonate detergents, and mixtures thereof, which may have a metal ratio of at least 8, as described, for example, in U.S. Pub. No. 2005065045. Linear alkyl benzenes may have the benzene ring attached anywhere on the linear chain, usually at the 2, 3, or 4 position, or be mixtures thereof. Linear alkylbenzene sulfonate detergents may be particularly useful for assisting in improving fuel economy.

In one embodiment, the alkylbenzene sulfonate detergent may be a branched alkylbenzene sulfonate, a linear alkylbenzene sulfonate, or mixtures thereof.

In one embodiment, the lubricating composition may be free of linear alkylbenzene sulfonate detergent. The sulfonate detergent may be a metal salt of one or more oil-soluble alkyl toluene sulfonate compounds as disclosed in U.S. Pub. No. 20080119378.

The lubricating composition may include at least 0.01 wt. % or at least 0.1 wt. %, detergent, and in some embodiments, up to 2 wt. %, or up to 1 wt. % detergent.

Antioxidants

The lubricating composition optionally further includes at least one antioxidant. Exemplary antioxidants useful herein include phenolic and aminic antioxidants, such as diarylamines, alkylated diarylamines, hindered phenols, and mixtures thereof. The diarylamine or alkylated diarylamine may be a phenyl-α-naphthylamine (PANA), an alkylated diphenylamine, an alkylated phenylnaphthylamine, or mixture thereof. Example alkylated diphenylamines include dinonyl diphenylamine, nonyl diphenylamine, octyl diphenylamine, dioctyl diphenylamine, didecyl diphenylamine, decyl diphenylamine, and mixtures thereof. Example alkylated diarylamines include octyl, dioctyl, nonyl, dinonyl, decyl and didecyl phenylnaphthylamines. Hindered phenol antioxidants often contain a secondary butyl and/or a tertiary butyl group as a steric hindering group. The phenol group may be further substituted with a hydrocarbyl group (e.g., a linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, and 4-dodecyl-2,6-di-tert-butylphenol. In one embodiment, the hindered phenol antioxidant may be an ester, such as those described in U.S. Pat. No. 6,559,105. One such hindered phenol ester is sold as Irganox™ L-135, obtainable from Ciba.

When present, the lubricating composition may include at least 0.1 wt. % or at least 0.5 wt. %, or at least 1 wt. % antioxidant, and in some embodiments, up to 3 wt. %, or up to 2.75 wt. % or up to 2.5 wt. % antioxidant.

Dispersants

The lubricating composition optionally further includes at least one dispersant other than the exemplary compound. Exemplary dispersants include succinimide dispersants, Mannich dispersants, succinamide dispersants, and polyolefin succinic acid esters, amides, and ester-amides, and mixtures thereof. The succinimide dispersant, where present, may be as described above for the succinimides described as useful for cation M.

The succinimide dispersant may be derived from an aliphatic polyamine, or mixtures thereof. The aliphatic polyamine may be an ethylenepolyamine, a propylenepolyamine, a butylenepolyamine, or a mixture thereof. In one embodiment the aliphatic polyamine may be an ethylenepolyamine. In one embodiment the aliphatic polyamine may be chosen from ethylenediamine, diethylenetriamine, triethylenetetramine, tetraethylenepentamine, pentaethylenehexamine, polyamine still bottoms, and mixtures thereof.

In one embodiment the dispersant may be a polyolefin succinic acid ester, amide, or ester-amide. A polyolefin succinic acid ester-amide may be a polyisobutylene succinic acid reacted with an alcohol (such as pentaerythritol) and a polyamine as described above. Example polyolefin succinic acid esters include polyisobutylene succinic acid esters of pentaerythritol and mixture thereof.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for example, in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, and 7,238,650 and EP Patent Application 0 355 895 A.

The succinimide dispersant may comprise a polyisobutylene succinimide, wherein the polyisobutylene from which polyisobutylene succinimide is derived has a number average molecular weight of 350 to 5000, or 750 to 2500.

The exemplary dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids, such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in U.S. Pub. No. 2009/0054278.

When present, the lubricating composition may include at least 0.01 wt. %, or at least 0.1 wt. %, or at least 0.5 wt. %, or at least 1 wt. % dispersant, and in some embodiments, up to 20 wt. %, or up to 15 wt. %, or up to 10 wt. %, or up to 6 wt. % or up to 3 wt. % dispersant.

Anti-Wear Agents

The lubricating composition optionally further includes at least one antiwear agent. Examples of suitable antiwear agents suitable for use herein include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The antiwear agent may in one embodiment include a tartrate, or tartrimide as described in U.S. Pub. Nos. 2006/0079413; 2006/0183647; and 2010/0081592. The tartrate or tartrimide may contain alkyl-ester groups, where the sum of carbon atoms on the alkyl groups is at least 8. The antiwear agent may, in one embodiment, include a citrate as is disclosed in US Pub. No. 20050198894.

The lubricating composition may in one embodiment further include a phosphorus-containing antiwear agent. Example phosphorus-containing antiwear agents include zinc dialkyldithiophosphates, phosphites, phosphates, phosphonates, and ammonium phosphate salts, and mixtures thereof.

When present, the lubricating composition may include at least 0.01 wt. %, or at least 0.1 wt. %, or at least 0.5 wt. % antiwear agent, and in some embodiments, up to 3 wt. %, or up to 1.5 wt. %, or up to 0.9 wt. antiwear agent.

Oil-Soluble Titanium Compounds

The lubricating composition may include one or more oil-soluble titanium compounds, which may function as antiwear agents, friction modifiers, antioxidants, deposit control additives, or more than one of these functions. Example oil-soluble titanium compounds are disclosed in U.S. Pat. No. 7,727,943 and U.S. Pub. No. 2006/0014651. Example oil soluble titanium compounds include titanium (IV) alkoxides, such as titanium (IV) isopropoxide and titanium (IV) 2 ethylhexoxide. Such alkoxides may be formed from a monohydric alcohol, a vicinal 1,2-diol, a polyol, or mixture thereof. The monohydric alkoxides may have 2 to 16, or 3 to 10 carbon atoms. In one embodiment, the titanium compound comprises the alkoxide of a vicinal 1,2-diol or polyol. 1,2-vicinal diols include fatty acid monoesters of glycerol, where the fatty acid may be, for example, oleic acid. Other example oil soluble titanium compounds include titanium carboxylates, such as titanium neodecanoate.

When present in the lubricating composition, the amount of oil-soluble titanium compounds is included as part of the antiwear agent.

Extreme Pressure (EP) Agents

The lubricating composition may include an extreme pressure agent. Example extreme pressure agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), hydrocarbyl-substituted 2,5-dimercapto-1,3,4-thiadiazoles and oligomers thereof, organic sulfides and polysulfides, such as dibenzyldisulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters, such as dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates, such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof. Some useful extreme pressure agents are described in U.S. Pat. No. 3,197,405.

When present, the lubricating composition may include at least 0.01 wt. %, or at least 0.1 wt. %, or at least 0.5 wt. % extreme pressure agent, and in some embodiments, up to 3 wt. %, or up to 1.5 wt. %, or up to 0.9 wt. % of the extreme pressure agent.

Foam Inhibitors

The lubricating composition may include a foam inhibitor. Foam inhibitors that may be useful in the lubricant composition include polysiloxanes; copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Viscosity Modifiers

The lubricating composition may include a viscosity modifier. Viscosity modifiers (also sometimes referred to as viscosity index improvers or viscosity improvers) useful in the lubricant composition are usually polymers, including polyisobutenes, polymethacrylates (PMA) and polymethacrylic acid esters, diene polymers, polyalkylstyrenes, esterified styrene-maleic anhydride copolymers, hydrogenated alkenylarene-conjugated diene copolymers and polyolefins also referred to as olefin copolymer or OCP. PMA's are prepared from mixtures of methacrylate monomers having different alkyl groups. The alkyl groups may be either straight chain or branched chain groups containing from 1 to 18 carbon atoms. Most PMA's are viscosity modifiers as well as pour point depressants. In one embodiment, the viscosity modifier is a polyolefin comprising ethylene and one or more higher olefin, such as propylene.

When present, the lubricating composition may include at least 0.01 wt. %, or at least 0.1 wt. %, or at least 0.3 wt. %, or at least 0.5 wt. % polymeric viscosity modifiers, and in some embodiments, up to 10 wt. %, or up to 5 wt. %, or up to 2.5 wt. % polymeric viscosity modifiers.

Corrosion Inhibitors and Metal Deactivators

The lubricating composition may include a corrosion inhibitor. Corrosion inhibitors/metal deactivators that may be useful in the exemplary lubricating composition include fatty amines, octylamine octanoate, condensation products of dodecenyl succinic acid or anhydride, and a fatty acid such as oleic acid with a polyamine, derivatives of benzotriazoles (e.g., tolyltriazole), 1,2,4-triazoles, benzimidazoles, 2-alkyldithiobenzimidazoles and 2-alkyldithiobenzothiazoles.

Pour Point Depressants

The lubricating composition may include a pour point depressant. Pour point depressants that may be useful in the exemplary lubricating composition include polyalphaolefins, esters of maleic anhydride-styrene copolymers, polymethacrylates, polyacrylates, and polyacrylamides.

Friction Modifiers

The lubricating composition may include a friction modifier. Friction modifiers that may be useful in the exemplary lubricating composition include fatty acid derivatives such as amines, esters, epoxides, fatty imidazolines, condensation products of carboxylic acids and polyalkylene-polyamines and amine salts of alkylphosphoric acids. The friction modifier may be an ash-free friction modifier. Such friction modifiers are those which typically not produce any sulfated ash when subjected to the conditions of ASTM D 874. An additive is referred to as "non-metal containing" if it does not contribute metal content to the lubricant composition. As used herein the term "fatty alkyl" or "fatty" in relation to friction modifiers means a carbon chain having 8 to 30 carbon atoms, typically a straight carbon chain.

In one embodiment, the ash-free friction modifier may be represented by the formula:

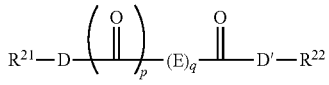

where, D and D' are independently selected from —O—, >NH, $>NR^{23}$, an imide group formed by taking together both D and D' groups and forming a $R^{21}$—N< group between two >C═O groups; E is selected from $—R^{24}—O—R^{25}—$, $>CH_2$, $>CHR^{26}$, $>CR^{26}R^{27}$, $>C(OH)(CO_2R^{22})$, $>C(CO_2R^{22})_2$, and $>CHOR^{28}$; where $R^{24}$ and $R^{25}$ are independently selected from $>CH_2$, $>CHR^{26}$, $>CR^{26}R^{27}$, $>C(OH)(CO_2R^{22})$, and $>CHOR^{28}$; q is 0 to 10, with the proviso that when q=1, E is not $>CH_2$, and when n=2, both Es are not $>CH_2$; p is 0 or 1; $R^{21}$ is independently hydrogen or a hydrocarbyl group, typically containing 1 to 150 carbon atoms, with the proviso that when $R^{21}$ is hydrogen, p is 0, and q is more than or equal to 1; $R^{22}$ is a hydrocarbyl group, typically containing 1 to 150 carbon atoms; $R^{23}$, $R^{24}$, $R^{25}$, $R^{26}$ and $R^{27}$ are independently hydrocarbyl groups; and $R^{28}$ is hydrogen or a hydrocarbyl group, typically containing 1 to 150 carbon atoms, or 4 to 32 carbon atoms, or 8 to 24 carbon atoms. In certain embodiments, the hydrocarbyl groups $R^{23}$, $R^{24}$, and $R^{25}$, may be linear or predominantly linear alkyl groups.

In certain embodiments, the ash-free friction modifier is a fatty ester, amide, or imide of various hydroxy-carboxylic acids, such as tartaric acid, malic acid lactic acid, glycolic acid, and mandelic acid. Examples of suitable materials include tartaric acid di(2-ethylhexyl) ester (i.e., di(2-ethylhexyl)tartrate), di($C_8$-$C_{10}$)tartrate, di($C_{12-15}$)tartrate, di-oleyltartrate, oleyltartrimide, and oleyl maleimide.

In certain embodiments, the ash-free friction modifier may be chosen from long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

The amount of the ash-free friction modifier in a lubricant may be 0.1 to 3 percent by weight (or 0.12 to 1.2 or 0.15 to 0.8 percent by weight). The material may also be present in a concentrate, alone or with other additives and with a lesser amount of oil. In a concentrate, the amount of material may be two to ten times the above concentration amounts.

Molybdenum compounds are also known as friction modifiers. The exemplary molybdenum compound does not contain dithiocarbamate moieties or ligands.

Nitrogen-containing molybdenum materials include molybdenum-amine compounds, as described in U.S. Pat. No. 6,329,327, and organomolybdenum compounds made from the reaction of a molybdenum source, fatty oil, and a diamine as described in U.S. Pat. No. 6,914,037. Other molybdenum compounds are disclosed in U.S. Pub. No. 20080280795. Molybdenum amine compounds may be obtained by reacting a compound containing a hexavalent molybdenum atom with a primary, secondary or tertiary amine represented by the formula $NR^{29}R^{30}R^{31}$, where each of $R^{29}$, $R^{30}$ and $R^{31}$ is independently hydrogen or a hydrocarbyl group of 1 to 32 carbon atoms and wherein at least one of $R^{29}$, $R^{30}$ and $R^{31}$ is a hydrocarbyl group of 4 or more carbon atoms or represented by the formula:

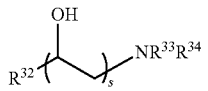

where $R^{32}$ represents a chain hydrocarbyl group having 10 or more carbon atoms, s is 0 or 1, $R^{33}$ and/or $R^{34}$ represents a hydrogen atom, a hydrocarbyl group, an alkanol group or an alkyl amino group having 2 to 4 carbon atoms, and when s=0, both $R^{33}$ and $R^{34}$ are not hydrogen atoms or hydrocarbon groups.

Specific examples of suitable amines include monoalkyl (or alkenyl) amines such as tetradecylamine, stearylamine, oleylamine, beef tallow alkylamine, hardened beef tallow alkylamine, and soybean oil alkylamine; dialkyl(or alkenyl) amines such as N-tetradecylmethylamine, N-pentadecylmethylamine, N-hexadecylmethylamine, N-stearylmethylamine, N-oleylmethylamine, N-dococylmethylamine, N-beef tallow alkyl methylamine, N-hardened beef tallow alkyl methylamine, N-soybean oil alkyl methylamine, ditetradecylamine, dipentadecylaimne, dihexadecylamine, distearylamine, dioleylamine, didococylamine, bis(2-hexyldecyl)amine, bis(2-octyldodecyl)amine, bis(2-decyltetradecyl) amine, beef tallow dialkylamine, hardened beef tallow dialkylamine, and soybean oil dialkylamine; and trialk(en) ylamines such as tetradecyldimethylamine, hexadecyldimethylamine, octadecyldimethylamine, beef tallow alkyldimethylamine, hardened beef tallow alkyldimethylamine, soybean oil alkyldimethylamine, dioleylmethylamine, tritetradecylamine, tristearylamine, and trioleylamine. Suitable secondary amines have two alkyl (or alkenyl) groups with 14 to 18 carbon atoms.

Examples of the compound containing the hexavalent molybdenum atom include molybdenum trioxides or hydrates thereof ($MoO_3.nH_2O$), molybdenum acid ($H_2MoO_4$), alkali metal molybdates ($Q_2MoO_4$) wherein Q represents an alkali metal such as sodium and potassium, ammonium molybdates $\{(NH_4)_2MoO_4$ or heptamolybdate $(NH_4)_6[Mo_7O_{24}].4H_2O\}$, $MoOCl_4$, $MoO_2Cl_2$, $MoO_2Br_2$, $MoO_3Cl_6$ and the like. Molybdenum trioxides or hydrates thereof, molybdenum acid, alkali metal molybdates and ammonium molybdates are often suitable because of their availability. In one embodiment, the lubricating composition comprises molybdenum amine compound.

Other organomolybdenum compounds of the invention may be the reaction products of fatty oils, mono-alkylated alkylene diamines and a molybdenum source. Materials of this sort are generally made in two steps, a first step involving the preparation of an aminoamide/glyceride mixture at high temperature, and a second step involving incorporation of the molybdenum.

Examples of fatty oils that may be used include cottonseed oil, groundnut oil, coconut oil, linseed oil, palm kernel oil, olive oil, corn oil, palm oil, castor oil, rapeseed oil (low or high erucic acids), soybean oil, sunflower oil, herring oil, sardine oil, and tallow. These fatty oils are generally known as glyceryl esters of fatty acids, triacylglycerols or triglycerides.

Examples of some mono-alkylated alkylene diamines that may be used include methylaminopropylamine, methylaminoethylamine, butylaminopropylamine, butylamino-ethylamine, octylaminopropylamine, octylaminoethylamine, dodecylaaminopropylaamine, dodecylaminoethylamine, hexadecylaminopropylamine, hexadecylaminoethylamine, octadecyl-aminopropylamine, octadecylaminoethylamine, isopropyloxypropyl-1,3-diaminopropane, and octyloxypropyl-1,3-diaminopropane. Mono-alkylated alkylene diamines derived from fatty acids may also be used. Examples include N-coco alkyl-1,3-propanediamine (Duomeen®C), N-tall oil alkyl-1,3-propanediamine (Duomeen®T) and N-oleyl-1,3-propanediamine (Duomeen®O), all commercially available from Akzo Nobel.

Sources of molybdenum for incorporation into the fatty oil/diamine complex are generally oxygen-containing molybdenum compounds include, similar to those above, ammonium molybdates, sodium molybdate, molybdenum oxides and mixtures thereof. One suitable molybdenum source comprises molybdenum trioxide ($MoO_3$).

Nitrogen-containing molybdenum compounds which are commercially available include, for example, Sakuralube® 710 available from Adeka which is a molybdenum amine compound, and Molyvan® 855, available from R. T. Vandebilt.

The nitrogen-containing molybdenum compound may be present in the lubricant composition at 0.005 to 2 wt. % of the composition, or 0.01 to 1.3 wt. %, or 0.02 to 1.0 wt. % of the composition. The molybdenum compound may provide the lubricant composition with 0 to 1000 ppm, or 5 to 1000 ppm, or 10 to 750 ppm 5 ppm to 300 ppm, or 20 ppm to 250 ppm of molybdenum.

Demulsifiers

Demulsifiers useful herein include trialkyl phosphates, and various polymers and copolymers of ethylene glycol, ethylene oxide, propylene oxide, and mixtures thereof.

Seal Swell Agents

Seal swell agents useful herein include sulfolene derivatives Exxon Necton-37™ (FN 1380) and Exxon Mineral Seal Oil™ (FN 3200).

Example Lubricating Compositions

An engine lubricant composition in different embodiments may have a composition as illustrated in Table 1. All additives are expressed on an oil-free basis.

TABLE 1

Example Lubricating Compositions

| Additive | Embodiments (wt. %) A | B | C |
|---|---|---|---|
| Amino-carboxylate compound | 1 to 30 | 5 to 25 | 10 to 20 |
| Overbased Sulfonate Detergent | 0 to 9 | 0.3 to 8 | 1 to 5 |
| Phenol-based detergent | 0.1 to 10 | 0.5 to 7 | 0.75 to 5 |
| (Borated) Dispersant | 0 to 12 | 0.5 to 8 | 1 to 5 |
| Antioxidant | 0 to 13 | 0.1 to 10 | 0.5 to 5 |
| Antiwear Agent | 0 to 15 | 0.1 to 10 | 0.3 to 5 |
| Corrosion Inhibitor | 0 to 2 | 0.1 to 1 | 0.2 to 0.5 |
| Friction Modifier | 0 to 6 | 0.05 to 4 | 0.1 to 2 |
| Viscosity Modifier | 0 to 10 | 0.5 to 8 | 1 to 6 |
| Other Performance Additives | 0 to 10 | 0 to 8 | 0 to 6 |
| Oil of Lubricating Viscosity | Balance to 100% | | |

Use of the Lubricating Composition

The end use of the lubricating composition described herein includes use as a cylinder lubricant for an internal combustion engine, such as a 2-stroke marine diesel engine, but may also find use as an engine oil for passenger car, heavy, medium and light duty diesel vehicles, small engines such as motorcycle and 2-stroke oil engines, as a driveline lubricant, including gear and automatic transmission oils, and for other industrial oils, such as hydraulic lubricants.

An exemplary method of lubricating a mechanical device, such as a 2-stroke marine diesel engine cylinder, includes supplying the exemplary lubricating composition to the device.

Generally, the lubricating composition is added to the lubricating system of an internal combustion engine, which then delivers the lubricating composition to the cylinder of the engine, during its operation, where it may be combusted with the fuel.

The internal combustion engine may be a diesel-fuelled engine, such as a 2-stroke marine diesel engine, or a gasoline fuelled engine, a natural gas fuelled engine, a mixed gasoline/alcohol fuelled engine, or a biodiesel fuelled engine. The internal combustion engine may be a 2-stroke or 4-stroke engine.

The lubricating composition may be suitable for use as a cylinder lubricant irrespective of the sulfur, phosphorus or sulfated ash (ASTM D-874) content of the fuel. The sulfur content of the lubricating composition, which is particularly suited to use as an engine oil lubricant, may be 1 wt % or less, or 0.8 wt % or less, or 0.5 wt % or less, or 0.3 wt % or less. In one embodiment, the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment, the phosphorus content may be 100 ppm to 1000 ppm, or 200 ppm to 600 ppm. The total sulfated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment, the sulfated ash content may be 0.05 wt % to 0.9 wt %, or 0.1 wt % to 0.2 wt % or to 0.45 wt %.

Without intending to limit the scope of the exemplary embodiment, the following examples illustrate preparation and evaluation of example compounds.

EXAMPLES

Example 1: Preparation of (IV)

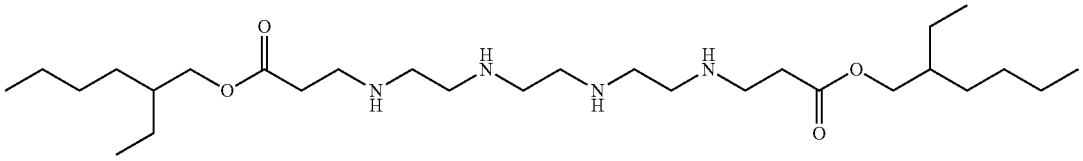

A 2 L 4-neck, round bottom flask, equipped with a Dean Stark apparatus and a nitrogen blanket (0.5 cfh), is charged with methanol (500 mL) and triethylenetetramine (TETA) (11.36 g). To this mixture is added 2-(ethylhexyl)acrylate (2-EHAc) (286.4 g) in a dropwise fashion over 90 minutes. An exotherm of 10° C. is observed. The reaction mixture is stirred for an additional 2.5 hours, after which the product is isolated by removal of the volatiles under reduced pressure. The product has a TBN of 399 mg KOH/g by ASTM D2896.

The following examples are prepared in a similar manner to Example 1 above and summarized in Table 2:

Example 2: Preparation of (VII)

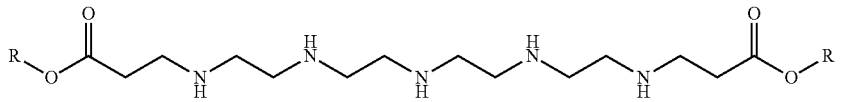

R═$C_{12}$-$C_{14}$ mixed alkyl groups

The compound was prepared by the reaction of tetraethylene pentamine (TEPA) with 2 equivalents of $C_{12-14}$ acrylate ($C_{12-14}$Ac). TBN=418 mg KOH/g (ASTM D2896)

Example 3: Preparation of (V)

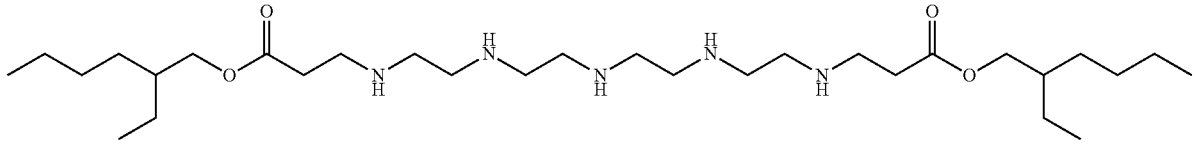

The compound was prepared by the reaction of TEPA with 2 equivalents of 2-EHAc. TBN=489 mg KOH/g (ASTM 2896).

Example 4: Preparation of (VI)

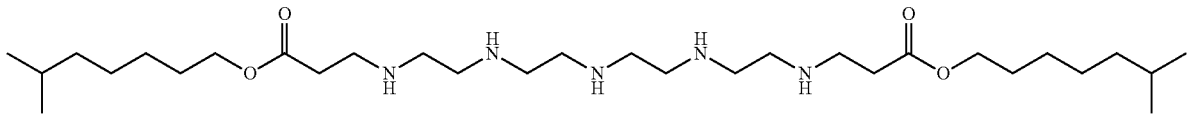

The compound was prepared by the reaction of TEPA with 2 equivalents of iso-octyl acrylate (iOAc). TBN=463 mg KOH/g (ASTM 2896).

Example 5: Preparation of (XI)

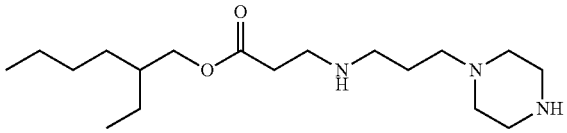

The compound was prepared by the reaction of (2-aminoethyl)piperazine with 2-EHAc. TBN=575 mg KOH/g (ASTM 2896).

Example 6: Preparation of (XII)

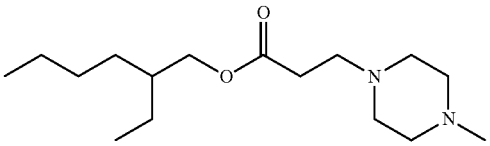

The compound was prepared by the reaction of 1-methylpiperazine with 2-EHAc. TBN=318 mg KOH/g (ASTM 2896).

Example 7: Preparation of (XIII)

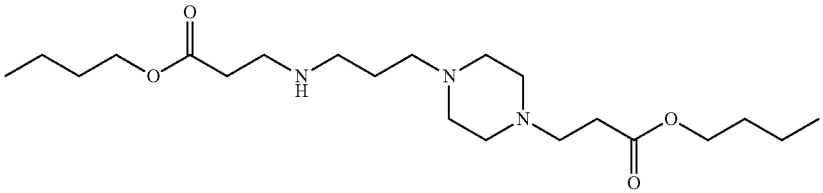

The compound was prepared by the reaction of piperazine with 2 equivalents of n-butyl acrylate. TBN=492 mg KOH/g (ASTM 2896).

Example 8: Preparation of (XIV)

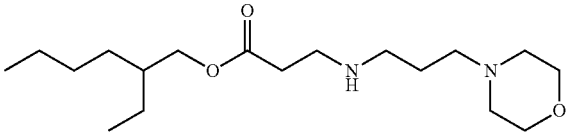

The compound was prepared by the reaction of 4-(aminopropyl)morpholine (APLM) with 2-EHAc. TBN=344 mg KOH/g (ASTM 2896).

Evaluation of Exemplary Compounds

The TBN and BN of several exemplary compounds are measured according to ASTM D2896 and ASTM D4739, as described above. Solubility is evaluated by treating each of them at 15 wt. % to a mixture of 4 wt. % detergent (106.14) in a 600N base fluid and examining the clarity of the mixture.

TABLE 2

TBN and Compatibility data for Example Compounds

| EXAMPLE | TBN (mg KOH/g) (ASTM D2896) | MW | Solubility |
|---|---|---|---|
| 1 | 398 | 506 | Clear |
| 2 | 418 | 698 | Clear |
| 3 | 489 | 565 | |
| 4 | 463 | 565 | |
| 5 | 575 | 327 | Clear |
| 6 | 318 | 284 | Clear |
| 7 | 492 | 399 | Clear |
| 8 | 344 | 316 | |

As can be seen, from Table 2, all of the compounds have a high TBN and, in general, are highly soluble in the test mixture at a high treat rate (15%).

Exemplary compounds are added at 13.4 wt. % to a typical marine diesel formulation with a TBN of 15.6. Table 3 shows the composition of the marine diesel formulation.

TABLE 3

Marine Diesel Formulation

| Ingredient | Wt. % |
|---|---|
| Example amino-carboxylate compound | 13.4 (except in baseline) |
| Overbased calcium alkylbenzene sulfonate detergent (400 TBN; 42% oil) | 0.75 |
| Neutral calcium alkylbenzene sulfonate detergent (TBN = 15; 50% oil) | 3 |
| Overbased calcium salixarate detergent (115 TBN; 51% oil) | 3 |
| Calcium phenate detergent (145 TBN; 27% oil) | 5.5 |
| Borated polyisobutylene succinimide dispersant (60 TBN; 33% oil) | 1 |
| Group I Base oil | Balance to 100% |

The resulting TBN was measured and the blend checked for compatibility. The results are summarized in Table 4.

TABLE 4

TBN and Compatibility data for Example Compounds in Marine Diesel Formulation

| Lubricating Example | Amine Example | TBN | Increase in TBN over Baseline | BN | Solubility |
|---|---|---|---|---|---|
| Baseline | — | 15.6 | | | |
| A | 1 | 67 | +51 | 50 | clear |
| B | 2 | 75 | +59 | 51 | clear |
| C | 6 | 84 | +68 | 57 | clear |
| D | 7 | 66 | +50 | 56 | clear |
| E | 9 | 59 | +43 | 55 | clear |
| F | 8 | 84 | +68 | 50 | n.d. |

As can be seen, all of the compounds in Table 4 increase the TBN of the formulation by a desirable amount and all of the blends are completely clear with no signs of incompatibility.

The blends were evaluated by panel coker testing, as follows: the sample, at 105° C., is splashed for 16 hours on an aluminum panel maintained at 325° C. The aluminum plates are analyzed using image analysis techniques to obtain a universal rating. The rating score is based on 100% being a clean plate and 0% being a plate wholly covered in deposit. Higher values are better, e.g., above 80% is good. The weight of deposit was also determined. The results are shown in Table 5, and compared with the baseline marine diesel formulation without the amino-carboxylate compound.

TABLE 5

| Panel Coker results | | | |
|---|---|---|---|
| Example | Amine Example | Deposit (mg) | Image Analysis (%) |
| Baseline | — | 4.9 | 85 |
| A | 1 | 2.4 | 84 |
| B | 2 | 1.2 | 82 |
| C | 6 | n/a | 20 |
| D | 7 | 1.6 | 92 |
| E | 9 | 17.8 | 89 |
| F | 8 | 4.3 | 90 |

With the exception of the lubricating composition C produced from Example 6, all of the TBN-boosted formulations perform well in the 16 hour panel coker test. Some of the boosted formulations show even better results than the baseline, suggesting that these amino-carboxylate compounds also serve as dispersants in the lubricating composition.

The neutralization rate for the TBN-boosted lubricating compositions was also evaluated. Nine MDCL formulations, eight of which contain the example amino-carboxylate compounds (which examples), were submitted for stopped-flow testing. While the neutralization rate of the baseline formulation is measurable by this method, the exemplary TBN-boosted lubricating compositions experience a color change that is faster than the resolution of the UV-Visible spectrometer, i.e., a very high neutralization rate.

Non-standard conditions are therefore adopted to generate measurable results. The test methodology includes increased acid concentration within the microemulsion droplets (0.05 M vs. 0.1 M) and a reduced temperature (6.8° C. vs. 18° C.).

The test involves mixing a detergent solution with a microemulsion solution containing sulfuric acid and the dye, phenol red. The phenol red dye has a characteristic absorbance peak $A_{max}$ at 560 nm for a pH of 8.0-12.0. Therefore, the test is effectively monitoring the change in the UV-visible spectrum associated with the formation of the basic form of the dye as base partitions at the oil-water interface. Even under these conditions, however, the exemplary lubricant compositions neutralized the acid so quickly as to be unobservable. This suggests a neutralization rate of at least about 300 times that of the baseline, although due to the reaction speed, an exact estimate of the difference is not possible.

In conclusion, the exemplary compounds can deliver TBN to a fully formulated MDCL oil, providing an additional 43 to 68 TBN, depending on the molecule. They are compatible with the MDCL oil, even at a treat rate of 13.4%.

Good performance is generally observed with panel coker testing. Dispersant action is expected. They have very fast neutralization capabilities, greatly increasing the rate of neutralization of the treated blend.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. By predominantly hydrocarbon character, it is meant that at least 70% or at least 80% of the atoms in the substituent are hydrogen or carbon.

Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, may contain other than carbon in a ring or chain otherwise composed of carbon atoms.

Representative alkyl groups include n-butyl, iso-butyl, sec-butyl, n-pentyl, amyl, neopentyl, n-hexyl, n-heptyl, secondary heptyl, n-octyl, secondary octyl, 2-ethyl hexyl, n-nonyl, secondary nonyl, undecyl, secondary undecyl, dodecyl, secondary dodecyl, tridecyl, secondary tridecyl, tetradecyl, secondary tetradecyl, hexadecyl, secondary hexadecyl, stearyl, icosyl, docosyl, tetracosyl, 2-butyloctyl, 2-butyldecyl, 2-hexyloctyl, 2-hexydecyl, 2-octyldecyl, 2-hexyldodecyl, 2-octyldodecyl, 2-decyltetradecyl, 2-dodecylhexadecyl, 2-hexyldecyloctyldecyl, 2-tetradecyloctyldecyl, monomethyl branched-isostearyl, and the like.

Representative aryl groups include phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, benzylphenyl, styrenated phenyl, p-cumylphenyl, α-naphthyl, β-naphthyl groups, and mixtures thereof.

Heteroatoms include sulfur, oxygen, nitrogen, and encompass substituents, such as pyridyl, furyl, thienyl and imidazolyl. In general, no more than two, and in one embodiment, no more than one, non-hydrocarbon substituent will be present for every ten carbon atoms in the hydrocarbyl group. In some embodiments, there are no non-hydrocarbon substituents in the hydrocarbyl group.

Representative aliphatic groups may contain 4 to 14 carbon atoms, 6 to 12 carbon atoms, or 8 to 10 carbon atoms. Examples of suitable alkyl groups include butyl, isobutyl, pentyl, isopentyl, neopentyl, hexyl, amyl, heptyl, octyl, iso-octyl, 2-ethylhexyl, nonyl, decyl, iso-decyl, undecyl, dodecyl, 2-propylheptyl, tridecyl, isotridecyl, tetradecyl, 4-methyl-2-pentyl, propyl heptyl, and combinations thereof.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed:

1. A lubricating composition comprising an oil of lubricating viscosity, an overbased metal-containing detergent, and an amino carboxylate compound of formula (I):

$$NR^1R^2—((CHR^3)_xNR^4)_n—(CHR^5)_2—COY, \quad (I)$$

where, $R^1$ and $R^2$ are independently selected from $(CHR^6)_2$—COY', H, and $C_1$-$C_3$ alkyl and wherein at least one of $R^1$ and $R^2$ is $(CHR^6)_2$—COY'; or wherein $NR^1R^2$ is an optionally substituted heterocyclic structure containing nitrogen and an additional hetero atom selected from oxygen and nitrogen;

Y and Y' are independently selected from —$OR^7$, —$NHR^7$, and —$N(R^7)_2$;

each $R^7$ is independently selected from $C_6$-$C_{12}$ alkyl and $C_6$-$C_{12}$ alkenyl;

$R^3$, $R^5$ and $R^6$ are independently selected from H and $C_1$-$C_4$ alkyl;

$R^4$ is selected from H, $C_1$-$C_4$ alkyl, and $(CHR^3)_x(NH_2$;

x is from 2 to 4; and n is at least 1, except where $NR^1R^2$ is a heterocyclic structure, where n is at least 0.

2. The lubricating composition according to claim 1, wherein x is 2.

3. The lubricating composition according to claim 2, wherein $R^3$ is H.

4. The lubricating composition according to claim 2, wherein n is at least 4.

5. The lubricating composition according to claim 1, wherein $R^3$, $R^4$, $R^5$ and $R^6$ are all H.

6. The lubricating composition according to claim 1, wherein at least one of Y and Y' is —$OR^7$.

7. The lubricating composition according to claim 6, wherein each $R^7$ is selected from $C_6$-$C_8$ alkyl and $C_6$-$C_8$ alkenyl.

8. The lubricating composition according to claim 1, wherein the compound has a structure according to Structure (II):

(II)

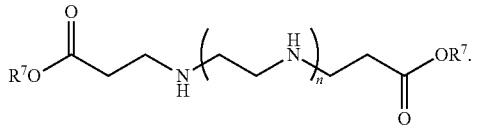

9. The lubricating composition according to claim 8, wherein n is at least 3, or up to 6, and wherein $R^7$ is selected from $C_6$-$C_8$ alkyl and alkenyl groups.

10. The lubricating composition according to claim 1, wherein $NR^1R^2$ is a heterocyclic structure selected from

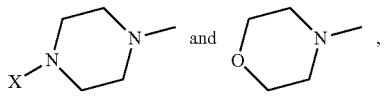

and wherein:

X is selected from H and —$(CH_2)_p$—W;

W is selected from $COOR^8$, $NHR^8$, and a heterocyclic structure as described for $NR^1R^2$ except that a terminal X is H or $C_1$-$C_4$ alkyl;

$R^8$ is selected from H, $C_6$-$C_{30}$ alkyl, and $C_6$-$C_{30}$ alkenyl, and

—$(CH_2)_p$—W, where W' is as for W, except that a terminal X is H or $C_1$-$C_4$ alkyl;

each p is from 2 to 4.

11. The lubricating composition according to claim 1, wherein the compound has a structure according to any one of:

(XI)

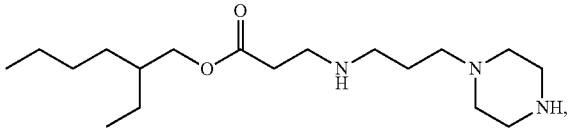

(XII)

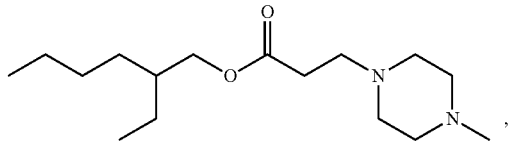

and mixtures thereof.

12. The lubricating composition according to claim 1, wherein the compound has a weight average molecular weight of up to 700, or up to 650.

13. The lubricating composition according to claim 1, wherein the amino-carboxylate compound is at least 1 wt. %, or at least 5 wt. %, or at least 10 wt. % of the lubricating composition.

14. A method of lubricating an engine, which comprises administering to the engine the lubricating composition according to claim 1.

15. A lubricating composition comprising an oil of lubricating viscosity and an amino carboxylate compound formed by Michael addition of an acylating agent and a polyamine, the acylating agent being represented by the general formula:

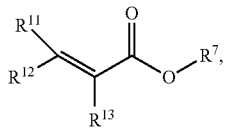

where $R^{13}$ is hydrogen or methyl, $R^{11}$ and $R^{12}$ are each independently selected from the group consisting of hydrogen, an alkyl group having from 1 to 12 carbon atoms, and a group having the formula —$COOR^{14}$ in which $R^{14}$ is hydrogen or an alkyl group having from 1 to 12 or 1-6 carbon atoms;

the polyamine being represented by the general formula:

$$NHR^4—((CHR^3)_xNR^4)_nR^4,$$

where x is from 2 to 4, $R^3$ is selected from H and $C_1$-$C_4$ alkyl, $R^4$ is selected from H, $C_1$-$C_4$ alkyl, and $(CHR^3)_xNH_2$, and n is at least 1.

* * * * *